US007394725B2

(12) United States Patent
Bloch

(10) Patent No.: US 7,394,725 B2
(45) Date of Patent: Jul. 1, 2008

(54) CLOCK FOR CHILDREN

(75) Inventor: Louis Bloch, Jerusalem (IL)

(73) Assignee: Ludoviq Ltd., Jerusalem (IL)

( * ) Notice: Subject to any disclaimer, the term of this patent is extended or adjusted under 35 U.S.C. 154(b) by 270 days.

(21) Appl. No.: 10/189,538

(22) Filed: Jul. 8, 2002

(65) Prior Publication Data

US 2003/0210611 A1 Nov. 13, 2003

Related U.S. Application Data

(63) Continuation-in-part of application No. 10/139,314, filed on May 7, 2002, now abandoned.

(51) Int. Cl.
*G04B 47/00* (2006.01)
*G04B 19/20* (2006.01)

(52) U.S. Cl. ..... 368/10; 368/77; 368/233

(58) Field of Classification Search ..... 368/76, 368/77, 79, 230, 231, 233, 239
See application file for complete search history.

(56) References Cited

U.S. PATENT DOCUMENTS

| | | | | |
|---|---|---|---|---|
| 2,493,138 | A * | 1/1950 | Hathaway | 434/304 |
| 4,759,002 | A * | 7/1988 | Cash | 368/15 |
| 5,023,849 | A * | 6/1991 | Vaucher | 368/15 |
| 5,050,139 | A * | 9/1991 | Oberst | 368/19 |
| 6,108,278 | A * | 8/2000 | Rochat | 368/28 |
| 6,754,139 | B2 * | 6/2004 | Herbstman et al. | 368/77 |
| 6,842,404 | B2 * | 1/2005 | Haselberger | 368/223 |

* cited by examiner

*Primary Examiner*—Edwin A. Leon
*Assistant Examiner*—Thanh S Phan
(74) *Attorney, Agent, or Firm*—Mark M. Friedman

(57) ABSTRACT

A method and device for representing the passage of time, in which a day is divided into long time periods and short time periods; the large time periods are indicated using a graphic representation and the small time periods are represented by coloring at least a portion of the graphic representation.

20 Claims, 9 Drawing Sheets

CLOCK FOR CHILDREN

This is a continuation-in-part of U.S. patent application Ser. No. 10/139,314 filed May 7, 2002 now abandoned.

FIELD AND BACKGROUND OF THE INVENTION

The present invention relates to languages and devices for visual representation of the passage of time, and specifically to a clock that is especially suited to children.

Devices for the visual portrayal of the passage of time range from concrete instantiations of slow-moving physical phenomena such as sundials and hourglasses, to more arbitrary paradigms developed along with specific motion or display technologies, i.e. dial clocks and digital clocks. These arbitrary representations have long survived the original mechanism that generated them and moved into the realm of language, retaining their meaning in relation to the time of day regardless of how the visual image is generated. Thus we may prefer a "digital" or "dial" clock interface on the screen of our computer or on our wrist, as a matter of taste and legibility. The mechanism that generates the changes in the visual portrayal can be based on atomic decay, piezoelectric pulses, mechanical action or any other phenomenon without affecting the resulting language of representation. The two dominant languages of dial and digital clocks, though arbitrary, are well enough accepted to perform the role of semiotic sign or marker throughout most of the world.

There have been many suggestions for variations on and alternatives to the two dominant languages, to improve legibility, aesthetics, or other factors. The prior art includes novel ways of representing hours, minutes, and other accepted divisions of time. Conceivably, displays could be based on other divisions of time or represent the flow of time without representing divisions per se.

The standard systems of representing time are dependent on familiarity with visual representations of numbers and comprehension of the clock hands as indicators within an otherwise static interface. Such interfaces are a priori unsuitable for children. Understanding the standard time representations requires a stage in child development more advanced than the stage at which a child can grasp the concept of the passage of time. Due to this misalignment, there is typically a protracted stage during which a child can grasp some of the concepts of time, but is prevented from doing this due to the difficulties of parsing written numerals and understanding the meaning of the position of the hands.

In the prior art are known devices and methods that attempt to make time telling easier for children. A review of earlier art will serve to illustrate their respective and collective lacunae.

U.S. Pat. No. 2,493,138 to Hathaway describes a time teaching device in the form of a standard clock with an attached verse-inscribed panel. The numeral indicia are augmented with pictures of animals and familiar objects and the hands of the clock are fashioned in the form of the storybook characters Jack and Jill. Hathaway teaches a working version with clockwork driven hands as well as a demonstration version in which the hands are only turned manually. The verses inscribed on the device refer to the pictures and the characters on the hands of the clock, relating them in storybook fashion to the hours of a child's day. Hathaway does not teach a new method of representing time, but merely attaches additional recognizable shapes to the sectors of the clock and to its hands. The cognitive steps necessary to differentiate between the two hands of the clock and to associate the location of the hand with a particular sector of the clock face are retained.

U.S. Pat. No. 5,526,327 to Cordova, Jr. describes a display and method for depicting the passage of time by selectively and progressively "filling" predetermined areas representing hours, minutes, seconds, and tenths of seconds. A user tells time by noting how much of a given area is filled. The display is configured in a variety of shapes with the possibility of assigning different parts of the shapes to the various time divisions. While Cordova teaches a new method of representing the passage of time, no improvement in legibility or comprehensibility is achieved.

A further disadvantage of Cordova is the inherent inaccuracy of depiction. The user is expected to calculate the relation of part to whole in determining hours on a 12 or 24 hour scale. This is cognitively difficult and can easily result in reading inaccuracies of one or two hours. A further disadvantage is in the depiction of small time divisions such as proposed for seconds or tenths of seconds. A device according to Cordova represents the passage of time over short intervals by rapidly flashing lights, detracting from the legibility and clarity of the entire display.

U.S. Pat. No. 5,044,961 to Bruskewitz describes a portable child activity timer designed to be comprehensible by children. A device according to Bruskewitz indicates pictorially what activity is being timed or what the child is waiting for, in addition to showing numerically how much time is left and indicating by means of a sound when a timed period is over. A device according to Bruskewitz is useful only for timing specific intervals and does not propose a new method of representing the time divisions of a day. The pictures on the timer relate to specific situations or events and are not associated with the time of day in a general sense.

Other devices configured to teach children time telling skills are found in Swiss Patent 540 542 to Ingold, U.S. Pat. No. 3,608,214 to Rancati, U.S. Pat. No. 3,967,389 to Brooks, U.S. Pat. No. 4,124,945 to Totten, and U.S. Pat. No. 4,219,943 to Grimes, all of which describe variations on the concept of time telling teaching devices or teaching clocks. These devices are not actual clocks, but rather teaching aids consisting of various discs, rings, and hands with printing, pictures and colors on them which are rotated manually around a central pivot in order to display a simulacrum of a clock face. Although colors are used to represent the various hours in a day, the devices teach no new time-telling language.

Thus, there is a need for, and it would be greatly advantageous to have a clock designed for children that familiarized them with the concepts of the passage of time, telling time, and associating given visual images with times of the day, using familiar images and colors to represent time. In addition, there is a need for, and it would be greatly advantageous to have a method of representing and telling time that is comprehensible and accessible to any person that is developmentally able to recognize images and colors.

SUMMARY OF THE INVENTION

The current invention provides a device that uses an alternative language of visual representation of the passage of time that is readable and comprehensible by any user, and in particular readable at the earliest possible stage of child development.

The current invention is of a clock that uses color and recognizable images to represent both the passage of time and the time of day in a form that is comprehensible to young children. For example, sections representing the 12 or 24 hours are arrayed around the circumference of a circular face as in a conventional clock face. However, instead of using hands to indicate the hour, the appropriate hour is indicated by an area of color that appears in an appropriate section. Each section of roughly 30° representing an hour has a graphic representation, for example of a recognizable character such as an animal, which remains fixed in place.

At least part of each graphic representation is transparent, such that a part of a colored disc placed behind the clock face is visible through these transparent sections or windows. The term "window", when used within this specification and subsequent claims, refers to a section of a component of the embodiment through which a more distant component is visible, irrespective of whether the more distant component is viewed through an open perforation in the nearer component or through a transparent section of the nearer component.

This colored disc is divided into areas of various colors which represent minutes or other subdivisions of time. The colored disk rotates, bringing successive colored areas into view through each of the windows of the characters. In this way, a time of day is represented by the association of a particular color with a particular recognizable character, for example, a yellow dolphin or a blue cat. The time resolution of the clock of the present invention as represented by the change of colors may vary. One embodiment of the invention is described where the colors change every 10 minutes, but it is clear that these intervals could be 5 minutes, 12 minutes, or any other period of time (but generally at least half of a long time period: thus if a long period was 1 hour, each short time period would be about 30 minutes or less). A further increase in resolution may be achieved by varying the pattern or intensity of the color on the color wheel or by progressively filling the area with color. In any case, the accuracy and precision of the timekeeping mechanism of the clock will be on the order of seconds or fractions of seconds in keeping with standard clock technology, and options will exist for displaying a concurrent readout of the time at a finer resolution than is represented by color alone. This concurrent readout enables proper setting of the clock, and offers a higher precision to those able to read it. A preferred embodiment of the current embodiment supplements the color-based display with an accurate minute display indicated by one or more sets of numbers printed on the color wheel.

In one preferred embodiment of the invention, a third separately rotating masking disc is disposed, for example, between the rotating colored disc and the fixed character disc, alternately screening and revealing the rotating colored disc in successive characters. This selective revealing could also be accomplished by placing the third masking disc behind translucent or transparent front discs and providing for natural or artificial lighting from behind the clock. This selective revealing could also be accomplished by other electrical or electrochemical or mechanical means.

In another preferred embodiment of the invention, a fourth activity disc, situated, for example, in the center of the clock face, is divided into sections with depictions of activities appropriate to different times of the day. This disc is also partially masked by the clock face, and rotates to consecutively reveal successive depictions. The rotation of the activity disc is continuous or discrete and, in some preferred embodiments, is programmable. At any moment, the activity disc shows one of a series of activities associated with a particular time of day.

Another preferred embodiment of the invention is readable by blind or visually impaired persons of all ages, while particularly adapted to children. In this preferred embodiment, the color disc is replaced by a texture disc that has varying tactile properties in separate areas. The masking disc and front face of the clock are necessarily perforated in this embodiment such that a person touching the face of the clock can feel the varying tactile properties of the texture disc behind. In this preferred embodiment, the characters on the face of the clock have a three-dimensional or otherwise tactilely distinguishable nature. As a further feature, auditory cues associated with particular times could be added to this or other embodiments.

The current invention overcomes the shortcomings noted in the prior art and provides a clock readable by anyone who has the ability to remember and recognize colors and figures such as animals. It is particularly suited for children and designed to provide both a useful representation of time, and a transitional educational tool to facilitate telling time with other methods. Unlike some previous examples, the current invention provides an actual functional clock that is accurate and consistent from day to day.

In addition, the present invention provides a clock for children that consistently associates a given recognizable image with a certain time such that the image/time sign or association is recognizable outside of the context of the clock face. Such an image can be used in other media directed towards preliterate children. For example, advertisements for upcoming television programs could carry an image indicating the time according to the time telling language of the present invention.

As is the case with any two-dimensional visual portrayal, the proposed language and its varying signs can be implemented on a computer display. Without ruling out computer displays or other electronic displays as a means of representing the proposed time telling language, a preferred embodiment of the present invention provides a stand-alone mechanism that represents the passage of time using the language of the present invention.

In addition, the proposed language is suitable for reproduction and use in other conventional methods of printing and publishing. Some of the more useful instances of such publishing are as a bulletin board or magnetic board with movable figures designed to teach the proposed language. A book that teaches the proposed language could be static or include moving parts that reproduce the rotary mechanism of the proposed invention. Likewise, a nonfunctional mock-up of a clock according to the current invention could be produced for use as an educational tool.

Any of these solutions could also use standard revolving clock hands as in those of a standard timepiece in addition to the described language as a transition device between the two languages of portraying time. The phrase "standard timepiece", when used within this specification and subsequent claims, refers to a rotary dial clock or watch that uses the familiar method of revolving hour and minute hand indicators to point to sectors of the clock face.

An additional preferred embodiment of the invention provides in addition to the main clock, a second device that uses two or more conventional clock hands to indicate an active graphic representation and an active color. The second device is useful for translating between the two systems of portraying time (the standard clock system and the system of the present invention), and is especially well suited for use as a parent's watch to aid in quick translation of time concepts between the two portrayals.

Thus the present invention provides for a second device which is substantially a standard timepiece having a face, an hour hand and a minute hand with a plurality of graphic representations radially distributed about the face, each graphic representation associated with an hour wherein the distribution of graphic representations is such that at any moment the hour hand substantially indicates a single individual graphic representation. In such a way, an adult user of the second device sees that the hour hand substantially points at, for example, a lion in the proximity of 12 o'clock and recognize that a lion is associated with the time period between 12:00 and 12:59. Further the second device of the present invention has a color-indication system associated with the minute hand, wherein a distinct color is associated with a time division, the time division being less than one hour. It is clear that the time division corresponding to each color of the second device is of a length equivalent to a corresponding children's clock of the present invention.

In one feature of the present invention, the association of the color indication system with the minute hand is a change of color of a part of the second device and the change of color is dependent on an orientation of the minute hand. For example, a LED capable of producing four different colors lights-up in a color according to the orientation of the minute hand, a first color for when the minute hand indicates the first quarter of an hour, a second color when the minute hand indicates the second quarter of an hour, a third color for when the minute hand indicates the third quarter of an hour, and a fourth color when the minute hand indicates the fourth quarter of an hour. Advantageously, the color change is of the minute hand itself.

In another feature of the present invention, the association of the color indication system with the minute hand is by an arrangement of colors radially distributed about the face of the second device (see FIG. 10). According to this feature, the second hand actually points to the appropriate color, the color being representative of the short time divisions, according to the method of the present invention.

According to the teachings of the present invention there is provided a device for indicating the association of times of day with events having a display substrate (e.g. an electronic displays, a bulletin boards a magnetic board (a board to which magnets stick) or a board which allows mechanical attachment of other objects) and a graphic representation in which a color is dominant, wherein the graphic representation indicates a long time period (according to the teachings of the present invention), and the dominant color of the graphic representation indicates a subdivision of the long time period, and a graphic representation of an event. Thus on the substrate is attached an event and the time it is done, where the time is indicated using the time-telling language of the present invention.

A further preferred embodiment of the current invention uses the proposed language over a shorter time period and is useful as an activity timer.

BRIEF DESCRIPTION OF THE DRAWINGS

The invention is herein described, by way of example only, with reference to the accompanying drawings, wherein.

DETAILED DESCRIPTION OF THE PREFERRED EMBODIMENTS

The device of the present invention is of a clock that uses color and recognizable images to represent both the passage of time and the time of day in a form that is comprehensible to young children.

The principles and operation of devices according to the present invention may be better understood with reference to the figures and the description hereinbelow.

It is clear that the details of the figures are by way of a non-limiting example and exclusively for the purposes of illustrative discussion of the preferred embodiments of the present invention only. Thus, the present invention is described in no more detail than is necessary for an understanding of the present invention. The description hereinbelow, together with the accompanying drawings, makes apparent to those skilled in the art how the invention may be realized.

Figure 1:
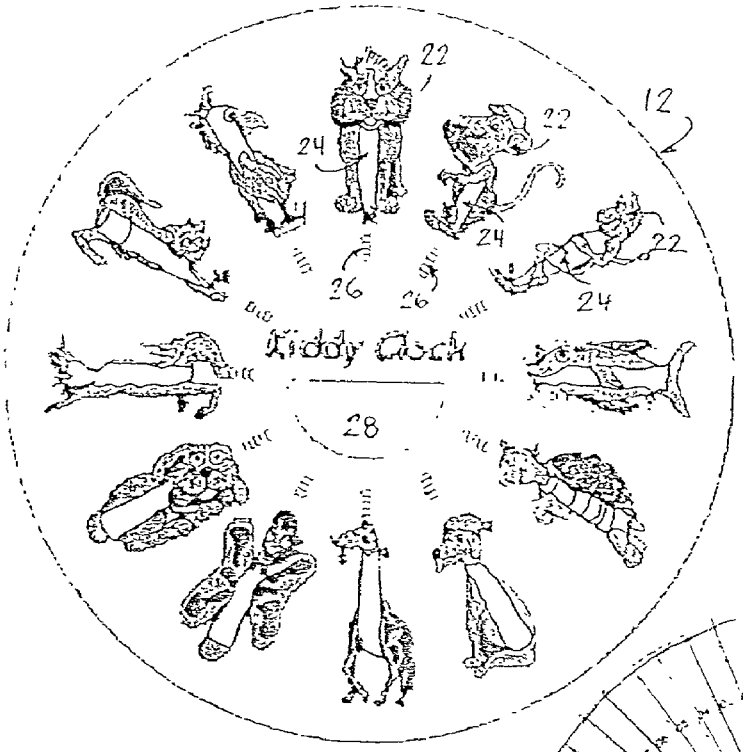
FIG. 1 is a front view of a face disc of a preferred embodiment of the invention.

FIG. 1 is a detailed front view of face disk 12. Face disk 12 is embossed or printed with a series of hour graphic representations 22 arrayed in a roughly circular arrangement. Each hour graphic representation 22 is perforated by at least one transparent or removed window 24, through which the other discs (see below and in FIG. 1) are at least partially visible. Further time fraction windows 26 are disposed between each hour graphic representation 22 and the center of face 12. Still further, an activity window 28 is disposed near the center of face 12. In the depicted embodiment, the width of window 24 as measured perpendicular to the radius of face 12 is approximately 6°, but in alternate embodiments it could be 12° or any other width, in coordination with the movement and divisions of the color wheel.

Figure 2:
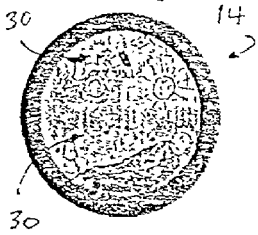
FIG. 2 is a front view of a activity wheel of a preferred embodiment of the invention.

FIG. 2 is a front view of activity wheel 14. Activity wheel 14 is embossed or printed with activity graphic representations 30 showing activities.

Figure 3:
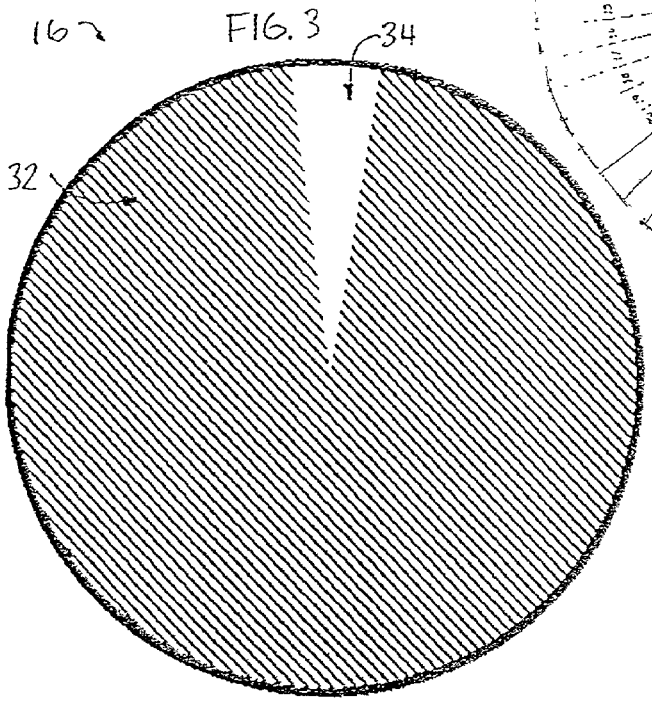
FIG. 3 is a front view of a hour mask of a preferred embodiment of the invention.

FIG. 3 is a front view of hour mask 16. Hour mask 16 has a solid or opaque portion 32 and a see-through window that is either transparent or is a window 34.

Figure 4:
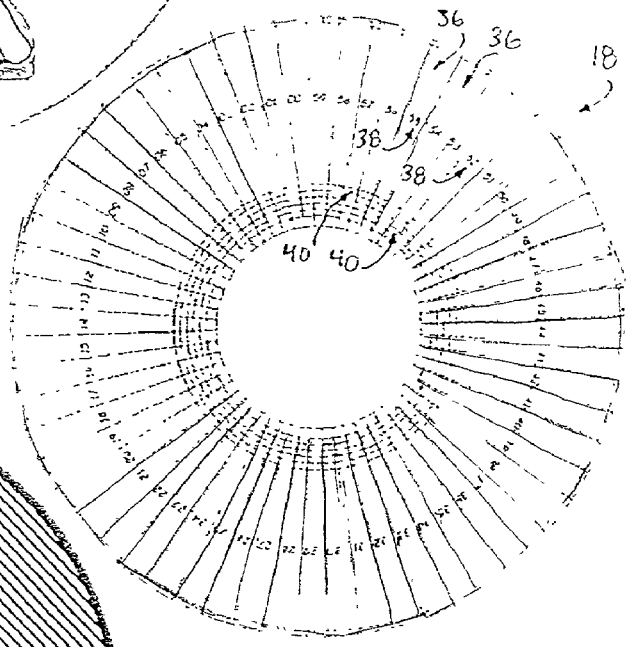
FIG. 4 is a front view of a color wheel of a preferred embodiment of the invention.

FIG. 4 is a front view of color wheel 18. Color wheel 18 is divided into radial sections 36 which are embossed or printed in various colors or patterns that may be distinguished from one another. Sections 36 may also be printed with a character or characters 38. These characters may represent time divisions such as minutes. Sections 36 are further divided into subsections 40 which may also be embossed or printed in various colors or patterns or graphic representations that may be distinguished from one another.

Figure 5:
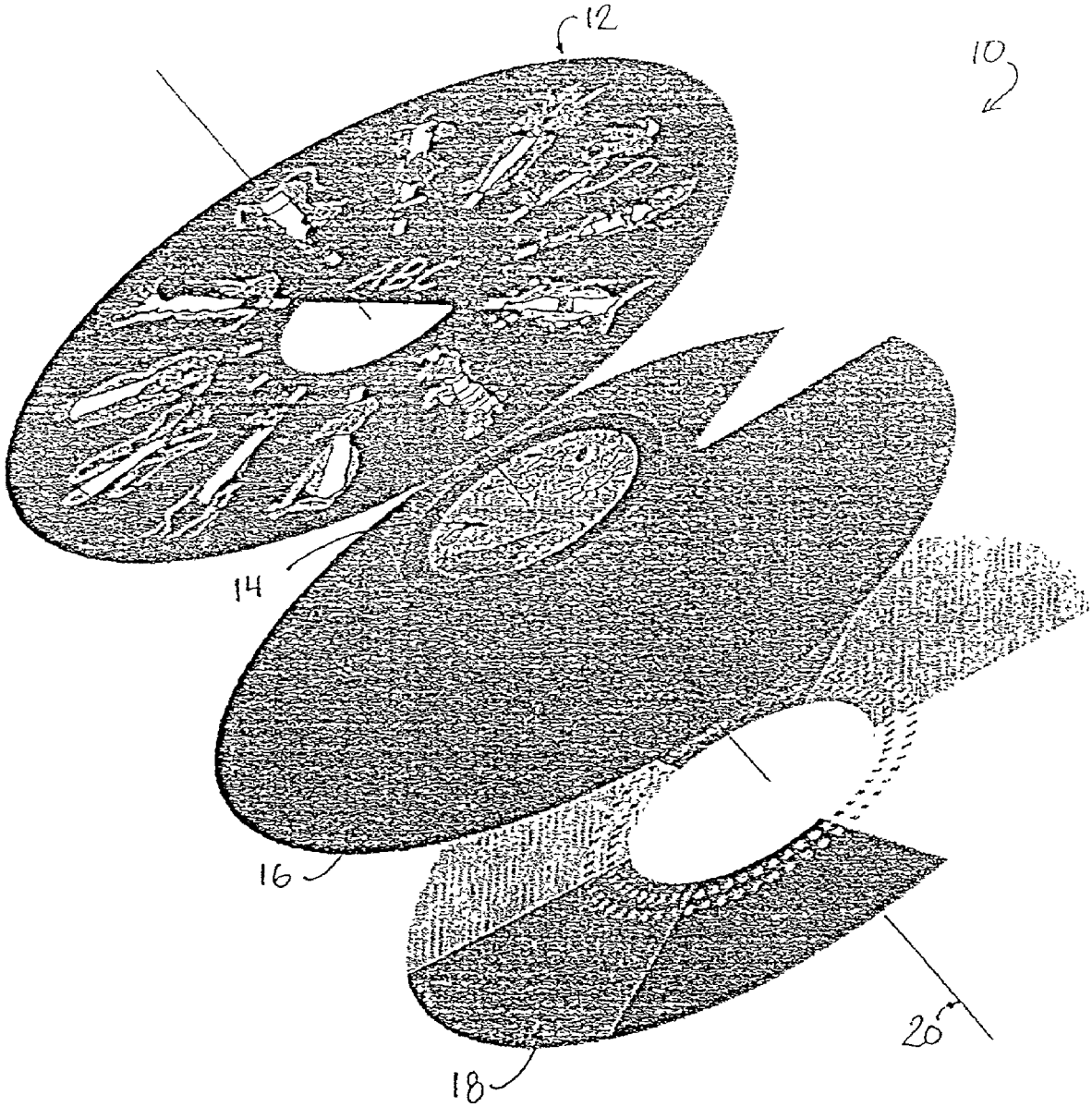
FIG. 5 is an exploded perspective of face disk, hour mask, color wheel and activity wheel of a preferred embodiment of the present invention.

FIG. 5 is an exploded perspective view of face disk, hour mask, color wheel and activity wheel of a preferred embodiment of the invention when assembled to make a single display assembly of a clock of the present invention. A display assembly 10 is composed of a face disk 12, an activity wheel 14, an hour mask 16, and a color wheel 18. Face disk 12, activity wheel 14, hour mask 16, and color wheel 18 are all individually rotatable around a common geometric axis 20.

While face disc 12 remains fixed, a mechanism (not shown) rotates activity wheel 14, hour mask 16, and color wheel 18 according to a schedule of time intervals. The rotation of activity wheel 14, hour mask 16, and color wheel 18 is such that at any one moment the see-through window 34 of hour mask 16 is located behind a single hour graphic representation 22 allowing a colored section 36 of color wheel 18 to be seen through an appropriate hour graphic representation 22. Typically, but not necessarily, hour mask 16 remains fixed behind face disk 12 for the period of one hour before rotating 30° clockwise. At any time, a color appears in behind only one-hour graphic representation 22, serving to indicate a particular hour. Color wheel 18 typically, but not necessarily, rotates one full revolution during an hour, bringing successive colors into view through window 24 and see-through window 34. The overall effect is such that an active or indicated hour graphic representation 22 appears distinctively colored while all other representations appear to be gray or other such "neutral" color. As color wheel 18 rotates, the visible color changes within the outline of an hour graphic representation 22, providing a visual representation of the passage of intervals less than an hour. In the depicted preferred embodiment, the color wheel rotates 6° each minute, such that a new section 36 is brought into view and after 10 minutes a second color is brought into view. In addition color wheel 18 rotates an additional 30° at the end of each hour to initiate the color cycle in the next graphic representation. Clearly, any time interval could be used. Independent of the rotation of hour mask 16 and color wheel 18, activity wheel 14 rotates at given intervals to bring successive activity graphic representations 30 into view through activity window 28. Whereas activity window 28 depicted in FIG. 5 is roughly 180°, it is clear that in other embodiments activity window 28 can be smaller.

At any time, a single successive activity graphic representation 30 appears, serving to indicate a particular activity for that time of day. In the preferred embodiment depicted in FIGS. 1 through 5, activity wheel 14 shows daytime and nighttime, cycling in a 24 hour period, but any time interval or number of activity graphic representations can be used.

Figure 6:
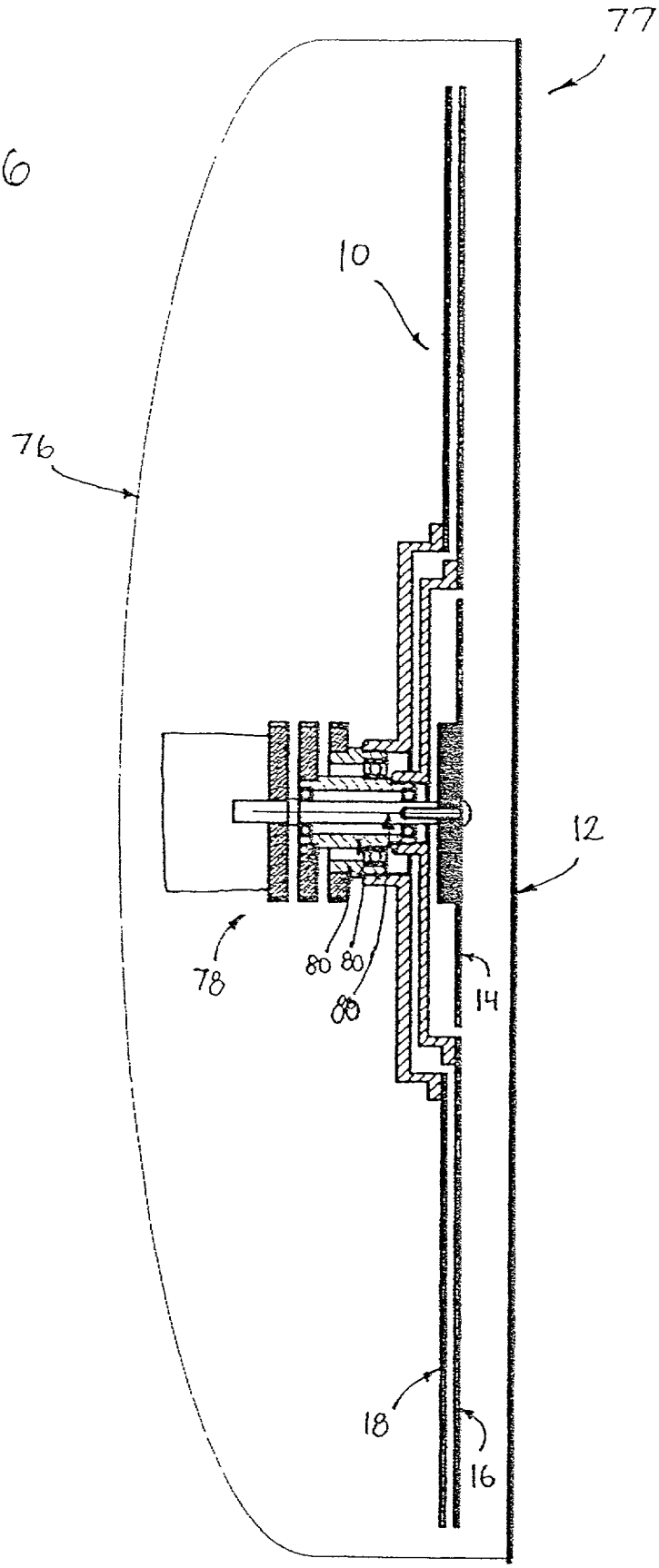
FIG. 6 is a cross section of a side-view of a preferred embodiment of the invention.

FIG. 6 is a side cross section of a preferred embodiment of the present invention. A back 76 is attached to face 12 forming a closed housing 77. Disposed within housing 77 is movement 78 and display assembly 10. Display assembly 10 is composed of activity wheel 14, hour mask 16, and color wheel 18, each connected to movement 78 by spindles 80. Movement 78 causes activity wheel 14, hour mask 16, and color wheel 18 to rotate at varying rates of speed.

Figure 7:
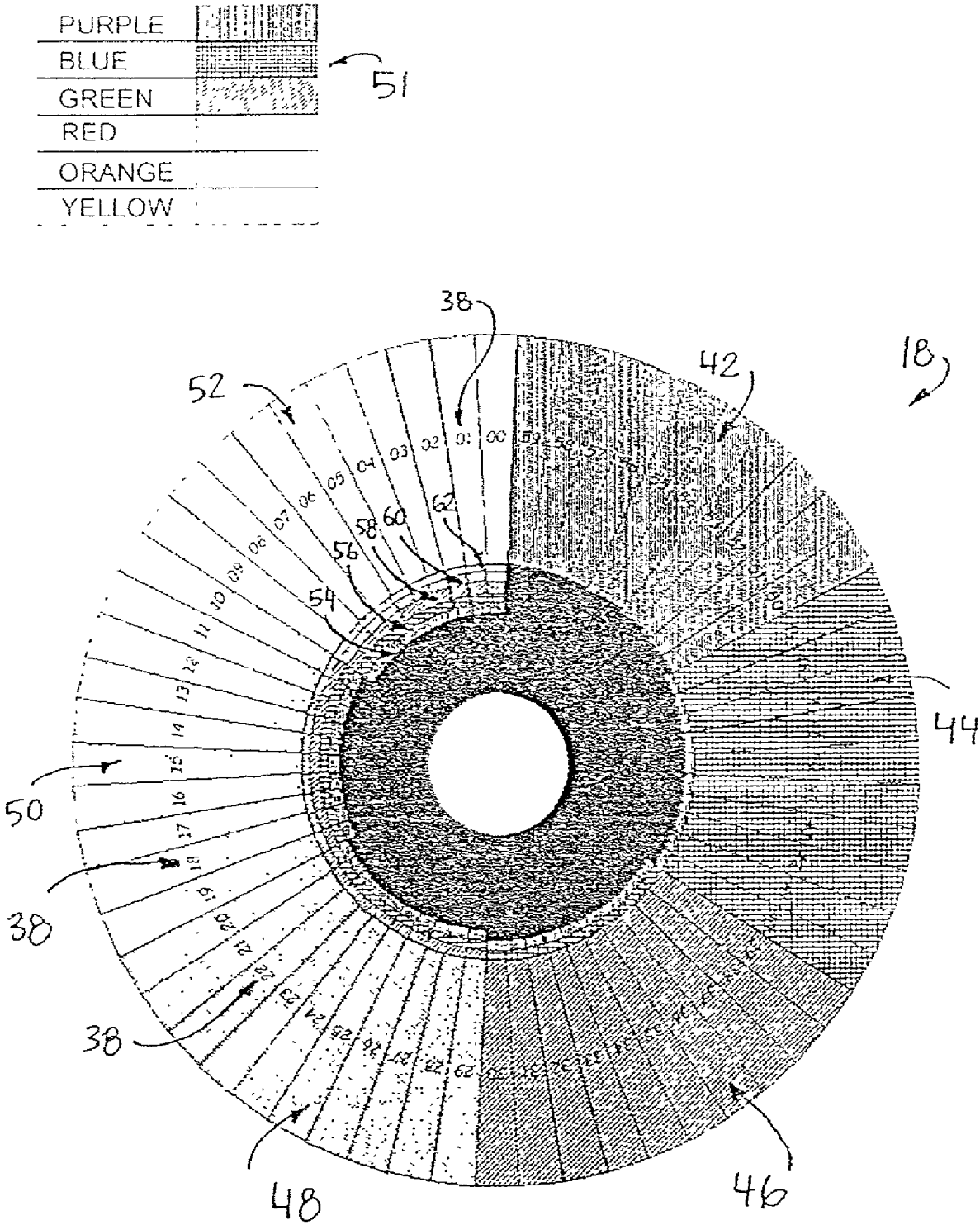
FIG. 7 is a detailed front view of a color wheel of a preferred embodiment of the invention.

FIG. 7 is a detailed view of color wheel 18. In FIG. 7, sections 36 are colored in various colors that are represented by various hatch patterns. Sections 36 can also be visually distinguishable from one another within any particular color area. The outer portion of color wheel 18 of FIG. 6 is composed of a purple area 42, a blue area 44, a green area 46, a red area 48, an orange area 50, and a yellow area 52. A table 51 shows the correspondence between the various colors and the hatching representations thereof. Smaller color areas are printed in an area closer to the center of color wheel 18. Visible adjacent to yellow area 52 are orange area 62, red area 60, green area 58, blue area 56, and purple area 54. Similar areas are disposed adjacent to blue area 44, green area 46, red area 48, and orange area 50. These smaller color areas are visible through windows 26 of face disk 12, and serve to indicate what portion of a certain hour remains, and which colors appear next in the sequence.

Activity wheel 14, hour mask 16, and color wheel 18, rotate at varying rates of speed such that the colored 42, 44, 46, 48, 50, and 52 of color wheel 18 are successively visible through windows 24 of face 12 in a timed sequence. Specifically, in the preferred embodiment depicted in FIGS. 1 through 6, activity wheel 14 is rotated 180° twice every 24 hours according to a programmable timer, hour mask 16 is rotated 30° clockwise every 60 minutes, and color wheel 18 of FIG. 6 is rotated 6° clockwise every minute and an additional 30° clockwise every 60 minutes in conjunction with hour mask 16, making colored areas 42, 44, 46, 48, 50, and 52 of color wheel 18 visible through a window 24 of face 12 and through transparent window 34 of hour mask 16 for 10 minutes each, with individual sections 36 visible for one minute each, while opaque section 32 of hour mask 16 is visible through all other windows 24 and 26 of face 12. Such a combination of discs and rotations activates a graphic representation 22 for one hour of every 12 hours by displaying a color, and represents a smaller increment of time by changing the color within graphic representation 22. Further resolution can be achieved by introducing varying patterns in individual wedges 36 of color wheel 18. In addition, alternate activity graphic representations 30 shown on activity wheel 14 will be visible through window 28 of face 12 at various times of the day. A further preferred embodiment rotates color wheel 18 12° every 2 minutes, allowing window 24 to have a width equivalent to 12° in a direction perpendicular to the radius of face 12.

Figure 8:
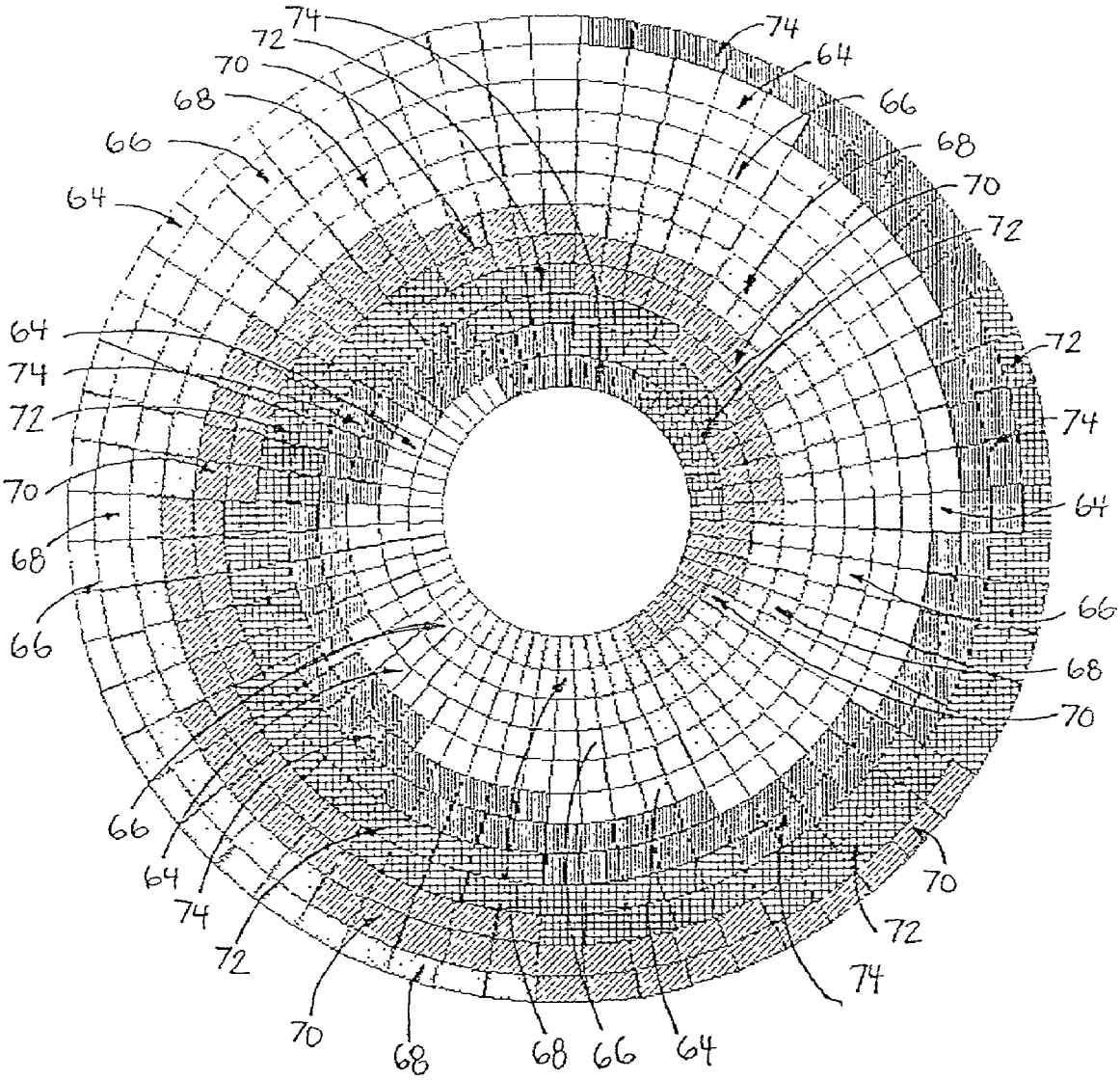
FIG. 8 is a front view of a color wheel of a further alternate preferred embodiment of the invention.

FIG. 8 is a detailed view of a second embodiment of a color wheel 18. In FIG. 8, color wheel 18 is divided into 72 colored sections represented by various hatch patterns. Visible are purple areas 74, blue areas 72, green areas 70, red areas 68, orange areas 66, and yellow areas 64. As in the previous embodiment, color wheel 18 is rotated behind face disc 12 and hour mask 16 such that successive colored sections are brought into view through small windows 34 and 24. These colored sections, when visible, indicate the passage of intervals of time shorter than one hour. In this embodiment color wheel 18 is rotated 6° every minute and hour mask 16 is rotated 30° clockwise every hour. No additional rotation of color wheel 18 is necessary. In this embodiment the perforations or transparent windows of face disk 12 are necessarily smaller in the direction parallel to the diameter of the clock face and appropriately offset from the center of the clock face. Each colored section relates to a specific graphic representation on face disk 12

Figure 9:
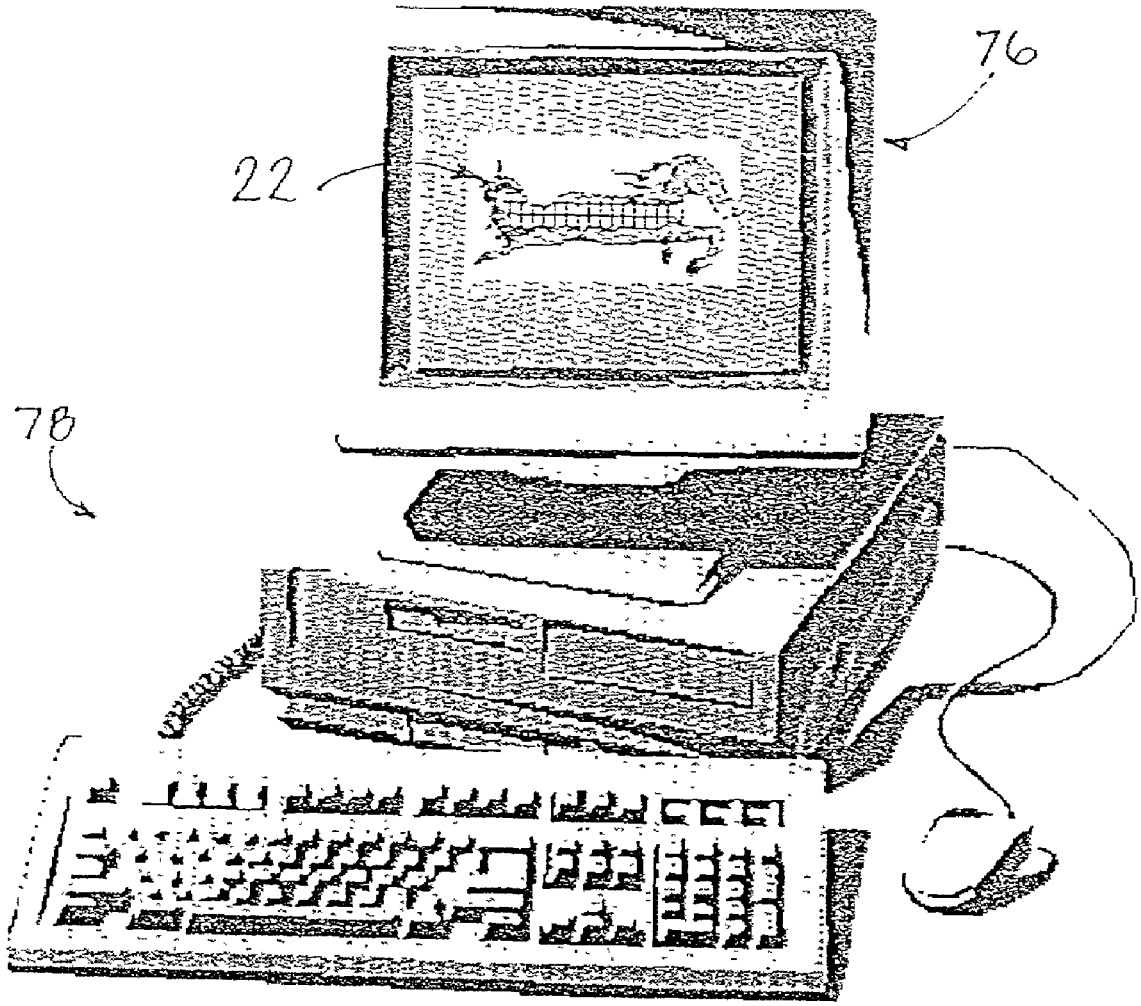
FIG. 9 is a perspective view of a computer displaying an embodiment of the invention.

In FIG. 9 is depicted an additional embodiment of a device of the present invention, made up of components including an electronic display device (computer monitor) 76 and a desktop computer 78. On electronic display device 76 appears an image substantially similar in appearance to an hour graphic representation 22. This representation 22 may be wholly or partially colored or otherwise visually distinguished, and the coloration may change to indicate the passage of intervals of time shorter than one hour.

Figure 10:
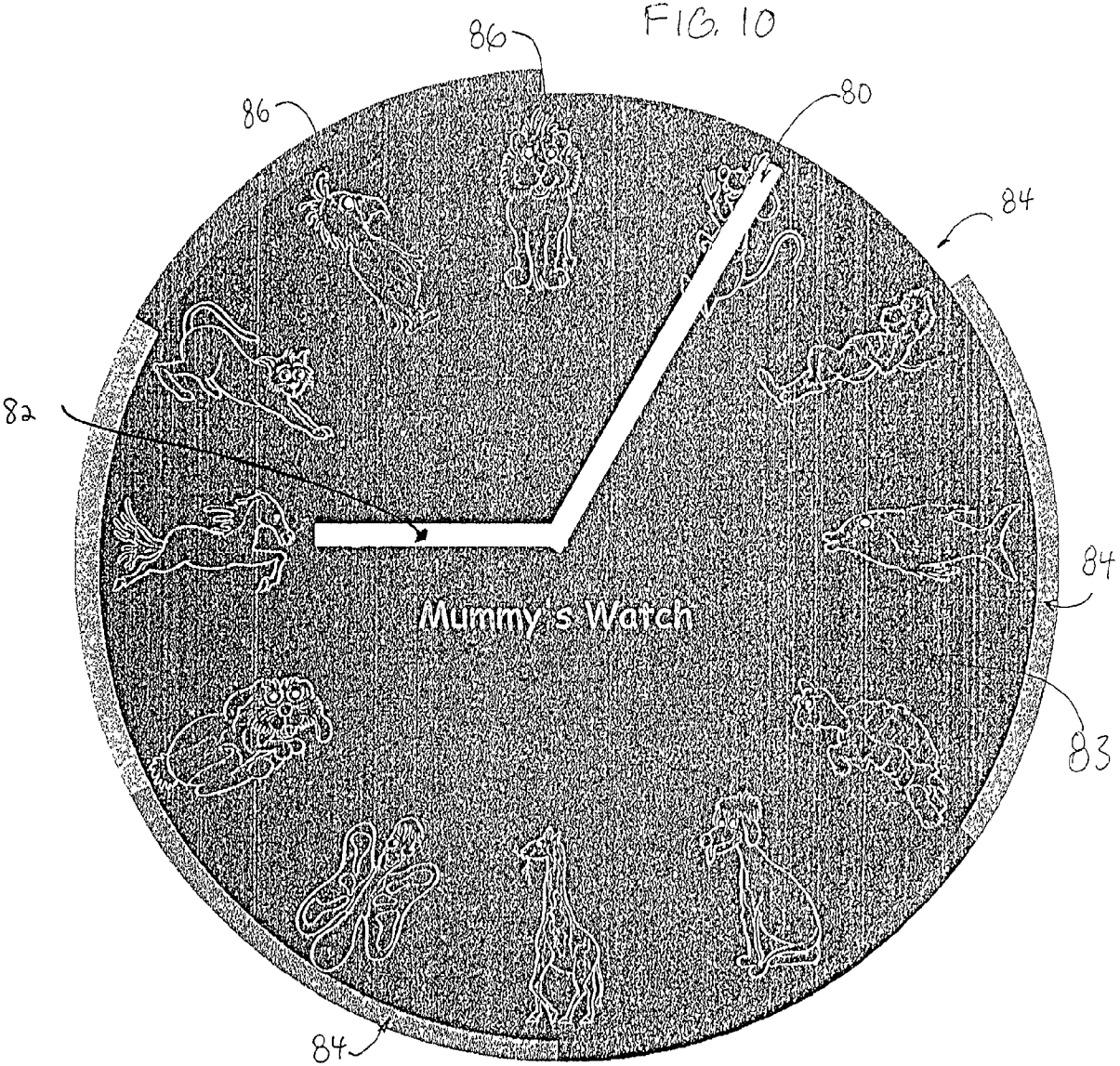
FIG. 10 is a front view of a further alternate preferred embodiment of the invention.

It is clear to one skilled in the art that on display device 76 it is also possible to simultaneously display a plurality of hour graphic representations 22 and to distinguish the active representation 22 from non-active representations, for example, by color FIG. 10 depicts a further preferred embodiment of the invention, suitable for simultaneously representing the time of day according to a conventional rotary dial paradigm and according to the character/color language described. This embodiment uses a standard rotary dial timepiece with a face that uniquely serves to represent both the standard rotary representation of the passage of time and the inventive representation. In this embodiment, a minute hand 80 and hour hand 82 are disposed in front of a clock face 83 containing two distinct concentric circular bands. In one of these bands a series of characters 86 is depicted in a substantially circular arrangement and the other band is divided into segments of visually distinct areas 84, for instance different colors. While the disposition alone of hands 80 and 82 are sufficient for time telling by a person skilled in reading a rotary dial clock, the characters and colors serve to make the invention readable by those who have learned the time telling language of the invention. In this embodiment, the short hand points to a character or figure indicating an hour while the long hand points to a color indicating a subdivision of the hour In addition this embodiment serves as a transitional representation and as a means of ready translation from one language to another.

Figure 11:
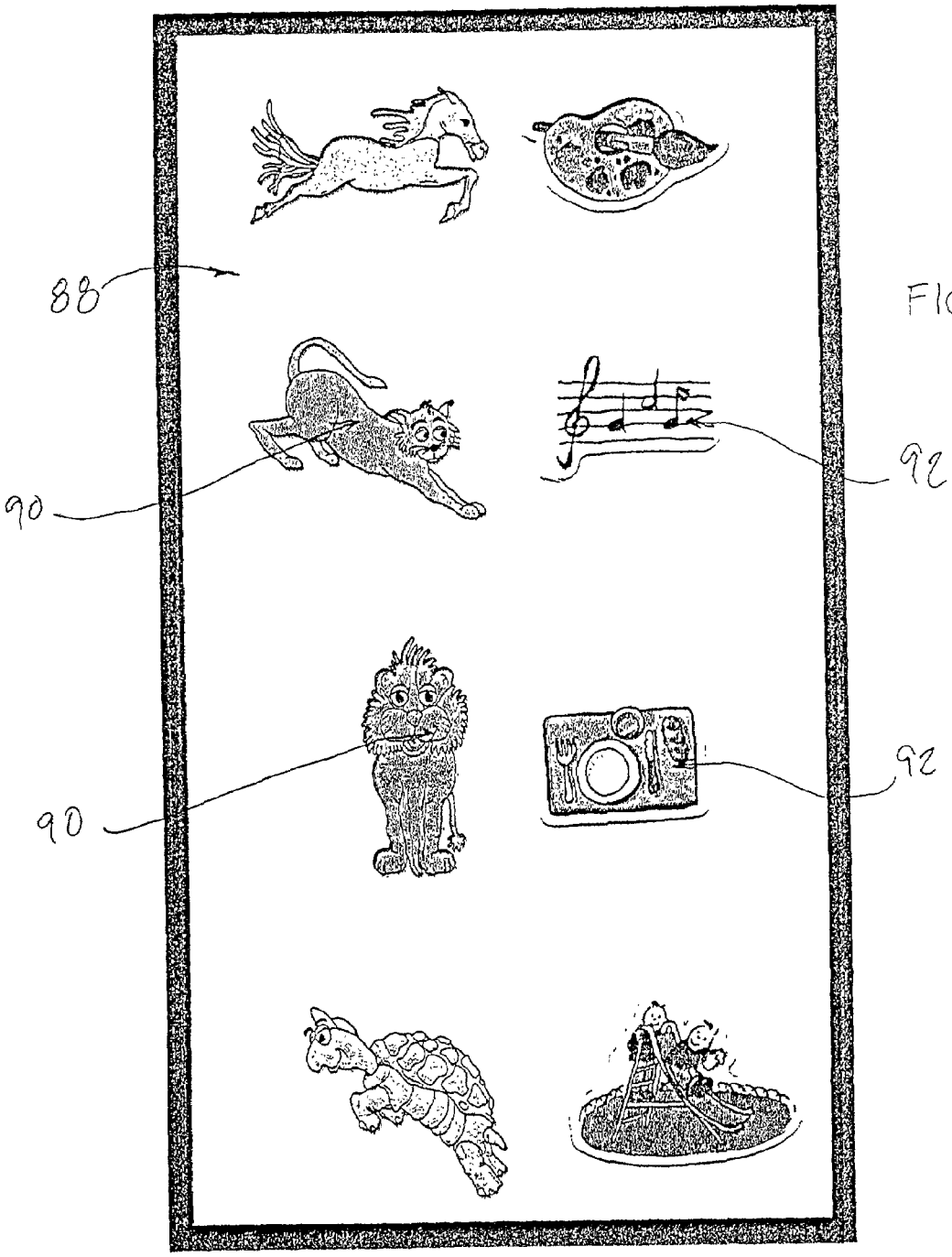
FIG. 11 is a front view of a further alternate preferred embodiment of the invention.

FIG. 11 depicts a further embodiment of the invention. A board 88 is the background for movable figures 90 that depict the time in the character/color language described and can be associated with other movable figures 92 that represent concepts associated with time, for example, activities.

Figure 12:
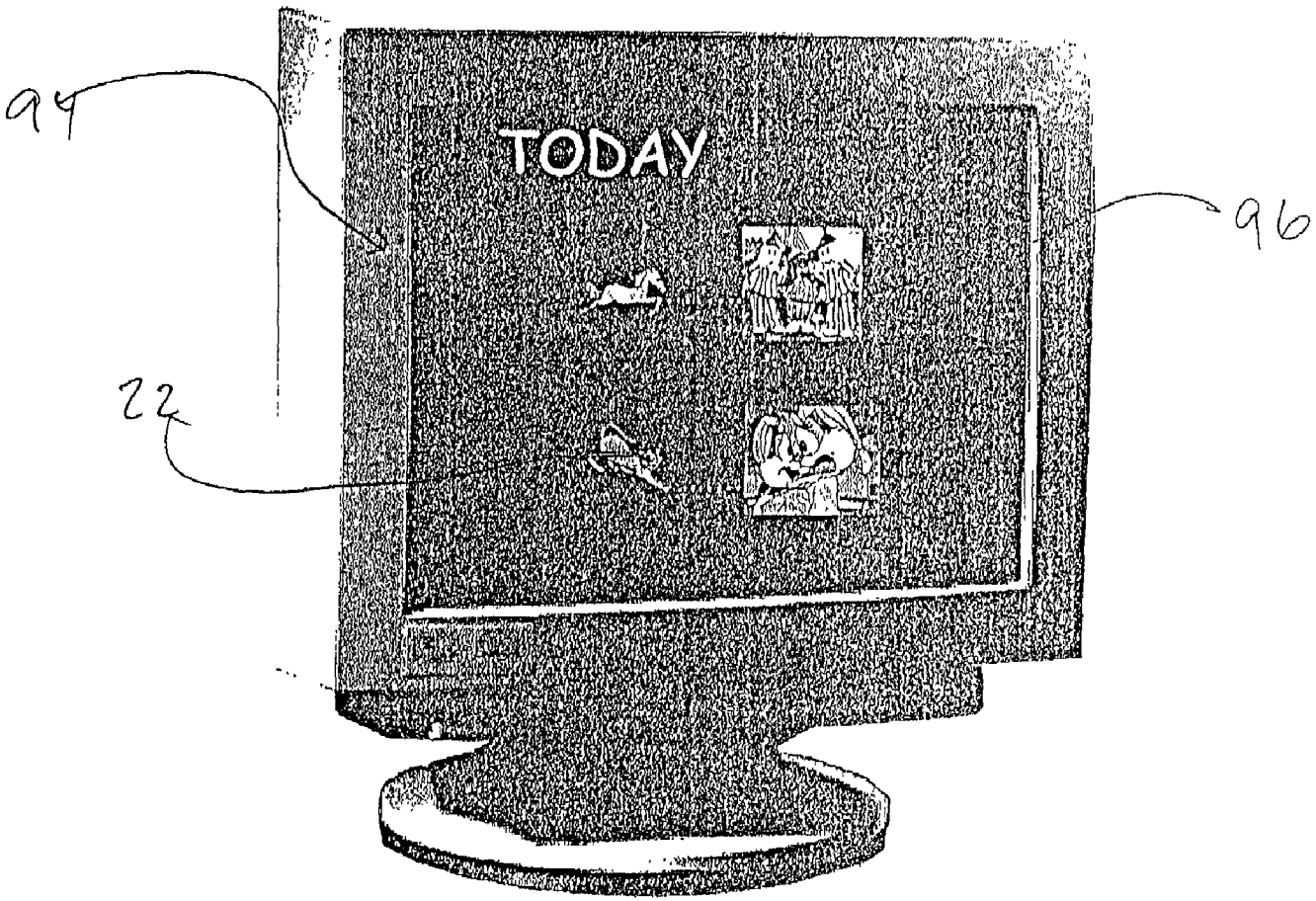
FIG. 12 is a perspective view of a computer displaying an embodiment of the invention.

FIG. 12 depicts a further preferred embodiment of the invention. In this embodiment, electronic display device 94 portrays a plurality of images substantially similar in appearance to hour graphic representations 96. These representations 96 may be wholly or partially colored or otherwise visually distinguished, and arranged in a table format along with corresponding time-related representations 98, for example, still or animated representations of television programs; such that the table can be understood as a schedule shown entirely in graphic form.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A device for representing the passage of time comprising:

a) a static face element having a visible surface;

b) a variety of graphic representations for representing each of a plurality of long time periods such that each graphic representation is unique to one of said long time periods, and at least a non-transparent portion of each of said variety of graphic representations is applied to said surface so as to be visible on an area of said surface;

c) a mechanism for visually changing at least a portion of only one said graphic representation at a time, such that a plurality of visual changes represents a plurality of short time periods, and said visual change alternates between all graphic representations in sequence, said mechanism including:

i) said face element configured as a face panel with a plurality of windows such that at least one of said plurality of windows is associated with only one said graphic representation; and ii) a rotating disc with a surface, said surface substantially hidden from view by said face panel, said surface having a first area and a second area that are identifiable as separate and distinct such that said first area indicates a predetermined short time period through at least one of said plurality of windows such that a duration of visibility of said rotating disk through each of said plurality of windows represents one said predetermined long period of time; and d) a mask deployed between said face panel and said rotating disc, said mask configured to reveal a portion of said surface of said rotating disc for one said long period of time through only that portion of said plurality of windows associated with only one of said plurality of graphic representations while blocking a view of said rotating disc through a remainder of said plurality of windows associated with a remainder of said plurality of graphic representations;

wherein a duration of association of said plurality of visual changes with one of said plurality of graphic representations represents a said long period of time.

2. The device of claim 1, wherein said first area comprises a plurality of sections such that a first said section is visually distinguishable from a second said section and all other said sections, and visually distinguishable from said second area.

3. The device of claim 1, further including said first area including a plurality of sections such that a first said section is tactilely distinguishable from a second said section and all other said sections, and tactilely distinguishable from said second area.

4. The device of claim 1, farther comprising a mechanism for rotating said rotating disc relative to said face panel.

5. The device of claim 4, wherein said mechanism rotates said rotating disc at a rate so that said first section is visible through said window for a time period of less than about 30 minutes.

6. The device of claim 1, wherein said mask is a rotating mask configured to remain in a fixed position behind face panel for the duration of one said long period of time before rotating a predetermined number of degrees so as to reveal said surface of said rotating disc through only that portion of said plurality of windows associated with only a next one of said plurality graphic representations.

7. The device of claim 1, farther comprising a mechanism for moving said mask relative to said face panel.

8. The device of claim 7, wherein said mechanism moves said mask at a rate so that said first area is visible though each of said windows for a time period of one hour.

9. The device of claim 1, wherein said face panel is decorated with a plurality of graphic representations disposed around said windows.

10. The device of claim 9, wherein at least one of said graphic representations is a graphic representation of an animal.

11. The device of claim 9, wherein at least one of said graphic representations is a graphic representation of an object.

12. The device of claim 1, wherein said visual change is a change in color.

13. The device of claim 1, wherein said mechanism for visually changing at least a portion of one said graphic representation includes:

a) a face panel with at least one window disposed in said face panel; and b) a user programmable rotating disc with a surface, said surface substantially hidden from view by said face panel, said surface having a first area and a second area and wherein at any given moment said first area is apparent in less than all of said windows and wherein said first area is distinguishable from said second area, and at least a portion of said first area represents a predetermined period of time.

14. The device for representing the passage of time of claim 13, wherein said first area is associated with an event.

15. A device for representing the passage of time comprising:

a) a static face element having a visible surface;

b) a variety of graphic representations for representing each of a plurality of long time periods such that each graphic representation is unique to one of said long time periods, and at least a non-transparent portion of each of said variety of graphic representations is applied to said surface so as to be visible on an area of said surface; and c) a mechanism for visually changing at least a portion of only one said graphic representation at a time, such that a plurality of visual changes represents a plurality of short time periods, and said visual change alternates between all graphic representations in sequence, including:

i) said face element configured as a face panel with a plurality of windows such that at least one of said plurality of windows is associated with only one said graphic representation; and ii) a rotating disc with a surface, said surface substantially hidden from view by said face panel, said surface having a first area and a second area that are identifiable as separate and distinct such that said first area indicates a predetermined short time period through at least one of said plurality of windows, such that a duration of visibility of said rotating disk through each of said plurality of windows represents one said predetermined long period of time;

wherein said visual change is a change in color and a duration of association of said plurality of visual changes with one of said plurality of graphic representations represents a said long period of time, the device further including a timepiece having:

d) a face, an hour hand and a minute hand;

e) said plurality of graphic representations radially distributed about said face, each graphic representation of said plurality being associated with an hour, wherein said distribution of said graphic representations of said plurality is such that said hour hand sequentially indicates a single individual graphic representation of said plurality; and f) a color-indication system associated with said minute hand, wherein a distinct color is associated with a said short time period, said short time period being less than one hour and a change in said distinct color represents an identifiable separate and distinct predetermined period of time;

wherein said change in said distinct color is similar to said visual change of said at least one graphic representation.

16. The device of claim 15, wherein said association of said color indication system with said minute hand is a change of color of a part of the device said change of color dependent on an orientation of said minute hand.

17. The device of claim 15, wherein said association of said color indication system with said minute hand is an arrangement of colors radially distributed about said face.

18. A device for representing the passage of time comprising:

a) a static face element having a visible surface;

b) a variety of graphic representations for representing each of a plurality of long time periods such that each graphic representation is unique to one of said long time periods, and at least a non-transparent portion of each of said variety of graphic representations is applied to said surface so as to be visible on an area of said surface; and c) a mechanism for visually changing at least a portion of only one said graphic representation at a time, such that a plurality of visual changes represents a plurality of short time periods, and said visual change alternates between all graphic representations in sequence, said mechanism for visually changing at least a portion of one said graphic representation including:

i) an electronic display, said display indicating:

A) at least one of said plurality of graphic representations; and

B) a distinct area disposed within said at least one of said plurality of graphic representation having a mutable appearance; and ii) a controller for changing said at least one of said plurality of graphic representation and said appearance of said distinct area;

wherein which of said at least one of said plurality of graphic representations is being displayed and a duration of display of said at least one of said plurality of graphic representation represents an identifiable separate and distinct predetermined said long period of time and a duration of said visual change in said graphic representation and said appearance of said distinct area represents an identifiable separate and distinct predetermined said short period of time.

19. The device for representing the passage of time of claim 18, wherein said controller is a computer.

20. The device for representing the passage of time of claim 19, wherein said display includes at least one LED array.

* * * * *